US006065644A

United States Patent [19]

Shipp, Jr.

[11] Patent Number: 6,065,644

[45] Date of Patent: May 23, 2000

[54] UNIDIRECTIONAL PASTE DISPENSER

[76] Inventor: Byron B. Shipp, Jr., 1024 Norwood Ave., Colorado Springs, Colo. 80906

[21] Appl. No.: 09/298,588

[22] Filed: Apr. 23, 1999

[51] Int. Cl.[7] ..... B65D 89/04

[52] U.S. Cl. ..... 222/94; 222/92; 222/107

[58] Field of Search ..... 222/92, 94, 107, 222/212, 215, 564, 547, 490, 494

[56] References Cited

U.S. PATENT DOCUMENTS

| | | | |
|---|---|---|---|
| 3,189,227 | 6/1965 | Hobbs et al. | 222/94 |
| 3,724,497 | 4/1973 | Federer et al. | 222/94 X |
| 4,846,370 | 7/1989 | Elleman et al. | 222/94 X |
| 5,169,030 | 12/1992 | Lewin | 222/107 X |

*Primary Examiner*—Kevin Shaver
*Assistant Examiner*—Thach Bui
*Attorney, Agent, or Firm*—Richard W. Hanes

[57] ABSTRACT

A squeezeable dispensing container for paste-like substances comprising, a closed tube having flexible side-walls and a selectively closeable dispensing aperture, a plurality of paste containing capsule members disposed in serially connected chains within the container, each capsule having an open base end and a convex end, and each having a check valve in the vertex of the convex end thereof that is openable and closable as a function of lateral pressure exerted on the capsule. Lateral pressure on the container and the capsules acts to extrude paste out of one capsule and into the next capsule in the chain. The check valves in each of the capsules prevents the paste from regressing in the container, permitting only the forward movement of the paste. toward the container's aperture.

6 Claims, 3 Drawing Sheets

UNIDIRECTIONAL PASTE DISPENSER

The present invention relates generally to the construction of a squeezable paste container and more specifically to apparatus that prevents the paste ingredients therein from regressing into the container from the point of application of compressive squeezing force on the container.

BACKGROUND

There are many types of storage containers for paste-like substances that depend upon pressure exerted on one or more sides of the container to squeeze its contents out of a closeable aperture in the end of the container. A toothpaste tube is only one example.

Unless, as the paste is dispensed from the top end, the tube is rolled up from its bottom end, at least some of the paste that is under pressure is going to retreat back into the emptied portion of the container instead of heading for the container's open dispensing aperture. The material from which the container is made, e.g. plastic, may prevent the container from being rolled up at all.

Once some of the paste regresses and re-inhabits the once emptied portion of the container, that section must be compressed again in order squeeze out the recalcitrant paste. Aside from the time and inconvenience experienced in re-squeezing the tube, there will always be some portion of the paste that is not removed, resulting in waste and inefficiency.

Accordingly, it is a primary objective of the present invention to provide a squeezable dispensing container that only allows the contents of the container to move in one direction, toward the dispensing aperture, when pressure is applied to the container.

SUMMARY OF THE INVENTION

The squeezable paste container of the present invention preferably includes a tube having an interior volume, sidewalls, a sealed bottom and a closeable top aperture. The walls of the tube are flexible or pliant to the extent that the tube may be manually squeezed to compress the sides of the tube together. Disposed inside of the tubular container are a plurality of side-by side chains of small open-ended, serially connected bulb shaped capsules. The longitudinal axes of the capsules and chains are generally parallel to the longitudinal axis of the tubular container. To form a chain, a number of the capsules are serially aligned so that the closed end of one capsule is nested into the open end of the next adjoining capsule in the chain. The closed end of each capsule is provided with an aperture that acts as a one way check valve, allowing the paste contents of one capsule to be extruded through the aperture and into the body of the next capsule in the chain. The aperture, acting as a check valve will allow the paste to exit, but it cannot return through the small aperture. The capsules are constructed of flexible or very pliant material that responds in deformation to compressive forces that tend to squeeze the sides of the capsule together.

Each of the plurality of capsules is filled with the paste or similar substance that is to be carried and dispensed by the tubular container. When the container is squeezed, the paste filled capsules that are located in the location of the squeezed portion are also squeezed, forcing the paste within the capsules out of the check valve aperture and into the adjoined capsule. The adjoining capsule, upon receiving material from the squeezed capsule emits material from its aperture into to the next succeeding capsule in the chain.

This progression continues until the capsules near the tubular container's top aperture emit their material that flows out of the container through the top aperture.

It is seen that once the paste or other material that is loaded into the capsules is advanced, by squeezing, toward the tube's top aperture, it cannot regress toward the bottom of the tubular container.

DETAILED DESCRIPTION OF THE INVENTION

For ease of explanation, the squeezable tubular container of the present invention will be generally referred to in this description as a toothpaste tube, or just a tube. All types of sqeezable containers and dispensers are intended to be covered by the general reference in this specification, and the claims that follow, to a tube or squeezable tube. All such containers can benefit from the objects and apparatus of the present invention. Similarly, in this specification and the claims that follow, the term "paste" will be deemed to refer to any kind of material that has a paste-like consistency, including toothpaste, glue, dough and any other soft plastic mixture or composition.

Figure 1:
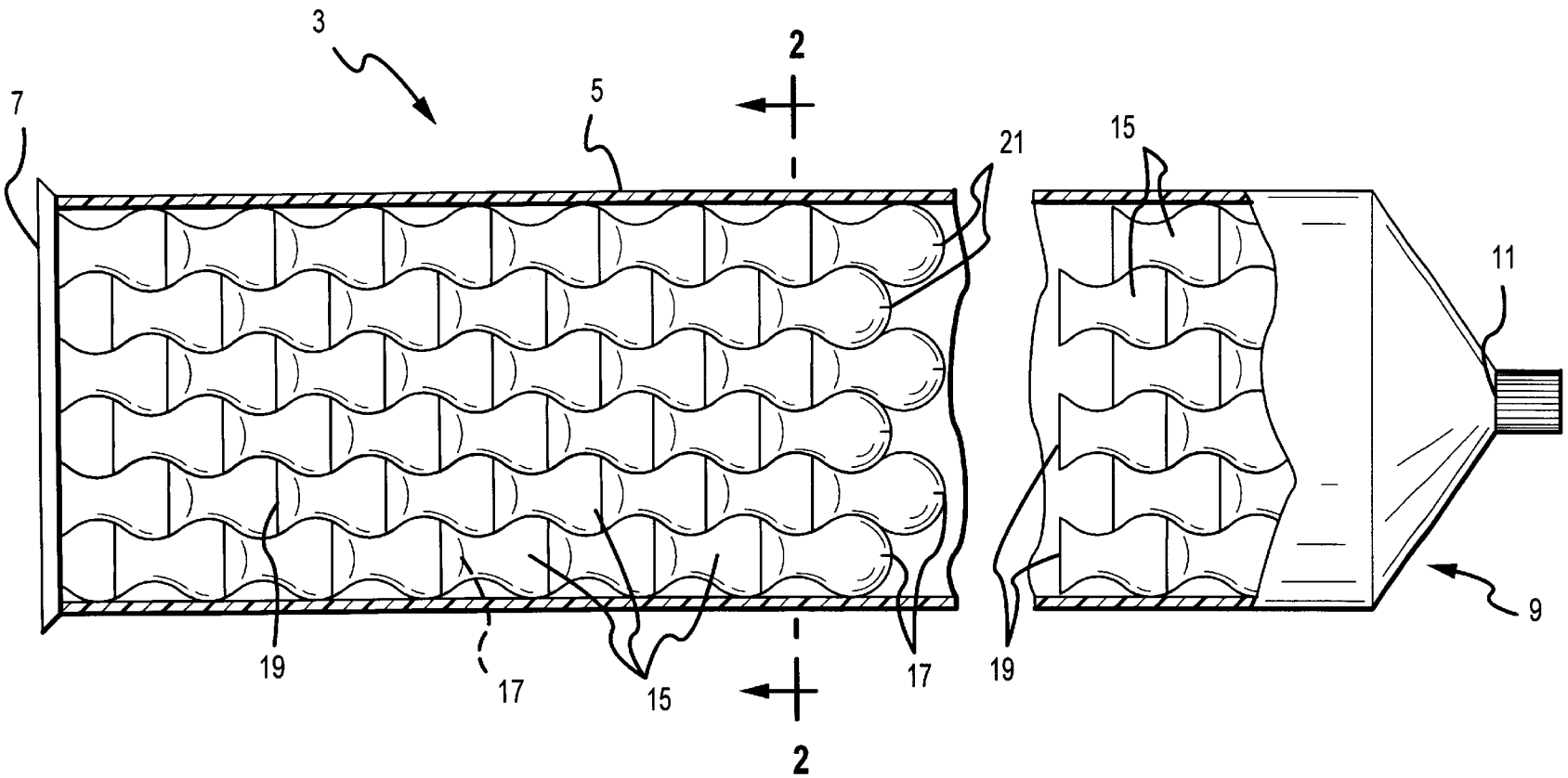
FIG. 1 is a cut-away view of a tubular shaped container of the present invention showing six chains of serially connected capsules across the diametric width of the container.
Figure 2:
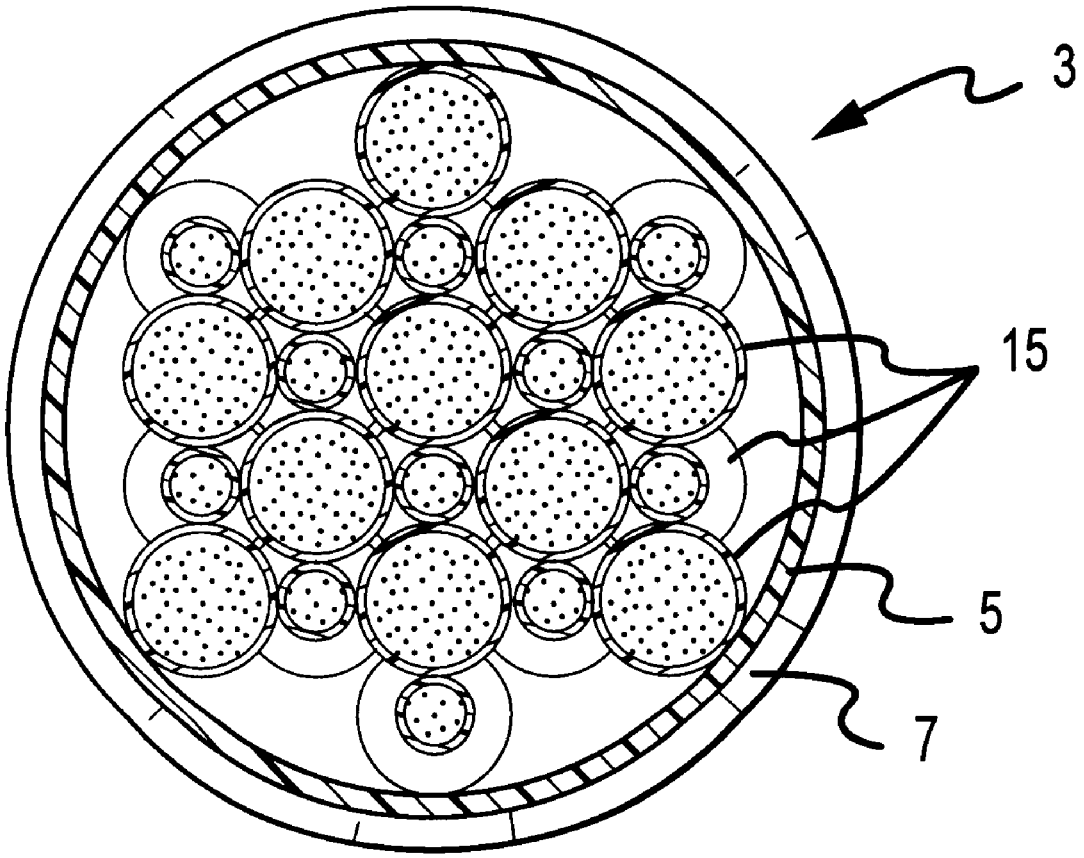
FIG. 2 is a cross sectional view of the container taken along lines 2—2 of FIG. 1.
Figure 3:
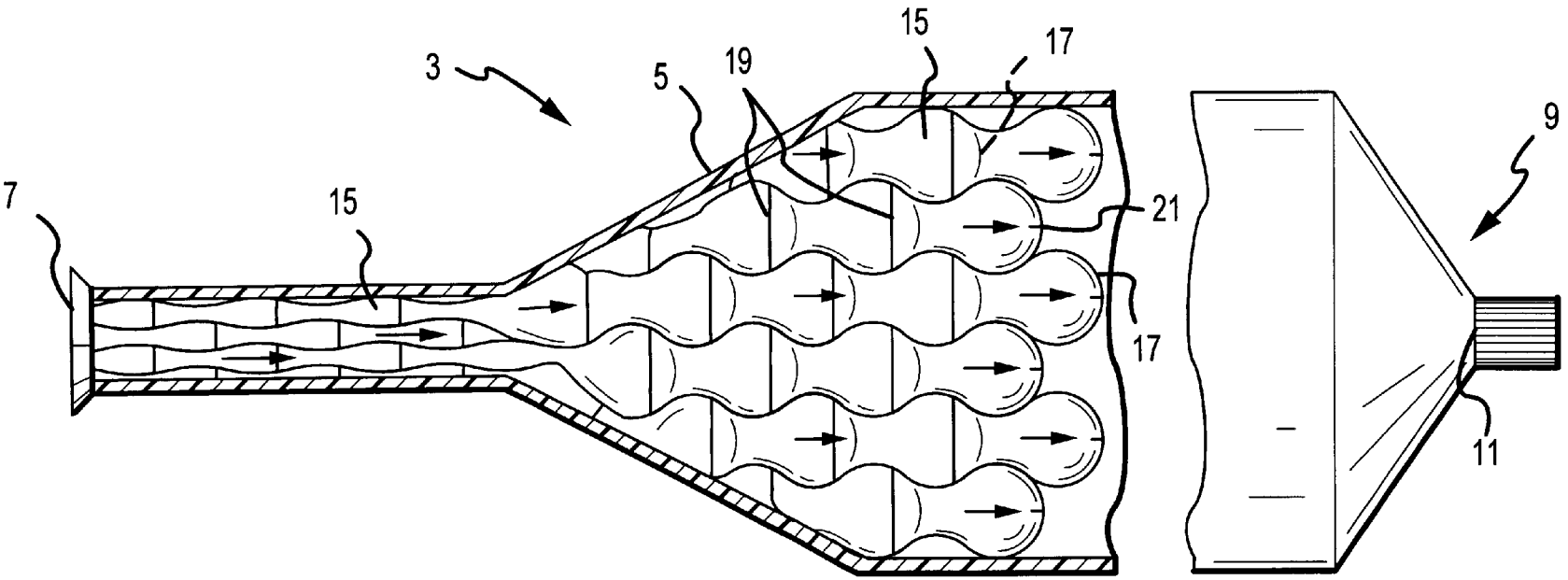
FIG. 3 is a a cut-away view of a tubular shaped container of the present invention showing the bottom portion thereof as having been squeezed to eject the material of pasty consistency therein.

FIGS. 1–3 illustrate the preferred form of the invention. A squeezable tube 3 is comprised of side walls 5 made of pliant, flexible, non-porous material that will contain paste. The bottom end 7 of the tube is crimped or sealed while the top end 9 of the tube contains a closeable aperture 11. Within the side walls of the tube 3 is a space adapted to hold paste which is to be dispensed through the aperture 11 when the tube is squeezed, in a manner that is known with respect to toothpaste tubes.

Contrary however to the construction of prior art paste dispensing tubes, the tube 3 of the present invention is provided, within its interior space, with a plurality of chains of serially connected capsules 15. Each of the capsules is fashioned in the form of a small open-ended bulb, or pod, each of which is loaded with the paste to be carried by the tube 3. The longitudinal axes of the capsule chains are either coaxial with or generally parallel to the longitudinal axis of the tube 3. As seen in the cross sectional view of FIG. 2, the loaded capsules 15 occupy substantially all of the cross sectional area of the tube 3. Each of the capsules shown in FIG. 2 is one of a chain of capsules that extends the length of the tubular container. The closed rounded end 17 of one capsule in the chain is nested into the open end 19 of an adjoining capsule and in sealing engagement therewith.

The closed rounded end 17 of each capsule contains an aperture 21 that serves as a one-way check valve, allowing the paste within the capsule to be ejected from the capsule but preventing the extruded paste from returning to the interior of the capsule. In the preferred embodiment the check valve aperture is merely an elongated slit 21 in the center of the rounded end 17.

In operation, as a portion of the tube is compressed by squeezing the side-walls of the tube, as shown in FIG. 3, the squeezing force is also felt by the capsules that are located within the tube. The compression forces to collapse the effected capsules, forcing the paste contained therein to be emitted from the slits 21. The ejection of paste from one capsule is a progressive event, filing the next capsule in the chain and forcing paste from the slit in that capsule into the next capsule in the chain. The paste in the capsules most proximate to the tube's aperture is extruded into and through the tube's aperture 11. Regardless of the location at which the tube 3 is squeezed, the paste can travel only toward to the tube's aperture 11. It cannot regress in the direction of the bottom of the tube.

The bulb shape of the capsules has been found to be most effective in modifying a lateral squeezing force into a force having a significant forwardly directed component, that is, toward the tube aperture. While the check valve slit 21 is a significant factor in preventing regression of the paste in the tube, the shape of the capsules is also a factor in preventing paste regression. This factor is implemented by the bulb's shape in creating a large aperture directed force component that ejects the paste forward.

I claim:

1. A squeezeable dispensing container for paste-like substances comprising, a closed tube having flexible side-walls and a selectively closeable dispensing aperture, a plurality of capsule members disposed within the container, each having an open base end and a convex end, and each having a check valve in the vertex of the convex end that is openable and closable as a function of lateral pressure exerted on the capsule, said capsules being arranged in a plurality of serially connected chains.

2. The combination of claim 1 wherein each chain comprises a plurality of axially aligned capsules where the check valve of one capsule is disposed in fluid communication with the open base of an adjoining capsule.

3. The dispensing container of claim 1 wherein the longitudinal axes of the capsules in the container are generally parallel with the longitudinal axis of the dispensing container.

4. The combination of claim 1 wherein the lateral cross section of the capsules is circular.

5. The combination of claim 1 wherein the capsules are bulb shaped.

6. The combination of claim 1 wherein the check valve comprises an elongated slit in the vertex of the capsule.

* * * * *